US005086576A

United States Patent [19]

Lamson

[11] Patent Number: 5,086,576

[45] Date of Patent: Feb. 11, 1992

[54] BICYCLE SHOE

[76] Inventor: Donald W. Lamson, 29155 Hook Creek Rd., Cedar Glen, Calif. 92320

[21] Appl. No.: 529,934

[22] Filed: May 29, 1990

[51] Int. Cl.[5] ..... A43B 5/14

[52] U.S. Cl. ..... 36/131; 36/3 R

[58] Field of Search ..... 36/131, 114, 3 R, 3 A

[56] References Cited

U.S. PATENT DOCUMENTS

| | | | |
|---|---|---|---|
| 343,777 | 6/1886 | Strickland | 36/131 |
| 2,147,197 | 2/1939 | Glidden | 36/3 A |
| 4,571,856 | 2/1986 | Lin et al. | 36/3 A |
| 4,815,222 | 3/1989 | Eisenbach et al. | 36/131 |
| 4,825,565 | 5/1989 | Bigolin | 36/131 |
| 4,845,864 | 7/1989 | Corliss | 36/131 |
| 4,876,808 | 10/1989 | Hsieh | 36/131 |
| 4,893,420 | 1/1990 | Bezin et al. | 36/131 |
| 4,907,355 | 3/1990 | Allen et al. | 36/131 |

*Primary Examiner*—Steven N. Meyers
*Attorney, Agent, or Firm*—Godfrey & Kahn

[57] ABSTRACT

A bicycle shoe for use in the sport of cycling including a unitary sole portion having a bottom panel which has interior and exterior facing surfaces; a stretchable envelope made integral with the interior facing surface of the bottom panel and which encloses the athlete's foot; a harness made integral with the interior facing surface of the bottom panel and which is disposed in a position exterior to the envelope, the harness operable to secure the shoe on the athlete's foot; a rigid insole received in the envelope and disposed in rested receipt in the interior facing of the bottom panel and a cushioned insole received in the envelope and disposed in rested receipt on the rigid insole and wherein the athlete's foot rests on the cushioned insole.

16 Claims, 4 Drawing Sheets

BICYCLE SHOE

BACKGROUND OF THE INVENTION

1. Field of the Invention

The present invention relates to a bicycle shoe for use by an athlete or other sports enthusiast and which is operable to facilitate the transfer of force from the operator's feet to the pedals of the bicycle thereby propelling the bicycle forwardly in a highly efficient fashion.

2. Description of the Prior Art

The prior art is replete with numerous prior art bicycle, or velocipede related devices which are adapted to be propelled by a man, alone and unaided, and which enable him to travel more quickly and easily over fairly long distances than would ever be possible on foot.

Historical records indicate that as long ago as 1817 there appeared a kind of vehicle known as a "drasine" after the name of its German inventor, Drais. This device consisted of two wooden wheels connected by a wooden frame. The operator of such a device sat upon it and could propel himself along by thrusting powerfully with his legs. Further, MacMillan in Scotland made a bicycle in 1839, the first of which that could be propelled without the rider's feet touching the ground. The MacMillan "hobby horse" had reciprocating cranks mounted to the front of the cycle which were connected by rods to the rear wheels. Moreover, in 1850, a man named Fisher devised a bicycle which mounted cranks and pedals to the front wheels. As a general matter, the bicycle of the modern era, which has evolved from these assorted historical curiosities typically has a frame manufactured out of strong, lightweight alloys, and a pair of derailleur assemblies are mounted on the frame and are operable to move a continuous chain between assorted sized sprockets for purposes of achieving selected gear ratios. More particularly, bicycles can now be purchased which have 3, 5, 10, and 15 and even 20 "speeds" or gearing combinations, which ar utilized when the bicycle is being propelled over assorted topography.

As of late, sports enthusiasts and other athletes have been participating in increasing numbers in triathlon competitions and various bicycle races. As should be understood in a triathlon, the competitor competes in three successive events, that is, a long distance swim, usually of several miles, followed by a 10 kilometer or longer foot race, and finally a bicycle race of 20 or more miles. The triathlon, of course, tests the strength and endurance of the athlete's entire body and therefore preparation for same requires a rigorous and often time consuming training program.

Triathletes and bicycle racers of all levels of ability have sought after various types of footwear which would provide them with a competitive advantage when competing in their respective athletic events. While the prior art is replete with assorted athletic footwear for use in long-distance running events, the development of competitive footwear for use in bicycle racing has been less than satisfactory. For example, one of the most popular brands of competitive bicycle racing shoes have a construction which includes a rigid and inflexible sole which is manufactured from wood, and which is operable to releasably mate with a bicycle pedal. Typically the upper portion of this same shoe was manufactured from natural and other synthetic materials. While this shoe design appears to operate in a generally satisfactory manner, the shoe was considered by most cyclists to be heavy and cumbersome to wear and was further uncomfortably hot during competition. In addition, other commercially available bicycling shoes have designs which have included a rigid insole manufactured from moldable or injectable polymers and which is received internally of the shoe. While this arrangement also has worked with some degree of success it has shortcomings inasmuch as the previously described problem of heat build-up during competition is also present in this design. Further, and although the rigid insole is lightweight thereby alleviating one of the earlier discussed problems regarding the weight of the shoe, the polymer insole does not provide the same performance characteristics as the rigid wooden sole therefore the cyclist does not gain the same competitive advantages as when employing a wooden sole shoe.

Still another deficiency common with respect to the prior art bicycle shoes results from characteristics inherent in their design inasmuch as these prior art shoes have usually been manufactured in a fashion similar to other athletic shoes such as running shoes although the physical forces experienced by a bicycling shoe are quite different. For example, the upper portions of bicycle shoes have characteristically exhibit structural failure after prolonged use due to the forces exerted on same by the cyclist.

Therefore, it has long been known that it would be desirable to have a bicycle shoe for use in competitive cycling, the shoe having particular utility when operatively and releasably mounted on a bicycle pedal, the bicycle shoe further maintaining the athlete s foot in force transmitting relation with the pedals thereby facilitating the transfer of force from the athlete's feet to the bicycle pedals.

SUMMARY OF THE INVENTION

Therefore it is the object of the present to provide an improved bicycle shoe.

Another object of the present invention is to provide such a bicycle shoe which has particular utility when operatively and releasably mounted on a bicycle pedal, the shoe including a unitary sole portion; a stretchable and breathable envelope made integral with the sole portion and which is adapted to enclose the athlete's foot; a harness made integral with the sole portion and which is disposed in a position exterior to the envelope thereby securing the bicycle shoe on the athlete's foot, and a rigid insole received in the envelope and disposed in rested relation on the sole portion and wherein the athlete's foot is supported by the rigid insole portion.

Another object of the present invention is to provide such a bicycle shoe which includes a removable cushioned insole which is adapted to be received in the envelope and disposed in rested relation on the rigid insole and wherein the rigid insole and the cushioned insole are readily removable from the envelope.

Another object of the present invention is to provide a bicycle shoe wherein the sole portion and the rigid insole include a plurality of substantially coaxially aligned apertures which are disposed in a predetermined pattern, and wherein the bicycle shoe further includes a plurality of threaded shafts which are individually slidably received in each of the apertures, and wherein the individual shafts are screwthreadably secured on a cleat which is operable to releasably mate with a bicycle pedal and related mounting fixture of conventional design.

Another object of the present invention is to provide a bicycle shoe wherein the sole portion includes at least one aperture which permits the flow of air into and out of the envelope thereby providing a means for ventilating the athlete's foot and releasing heat energy which is trapped within the shoe.

Another object of the present invention is to provide a bicycle shoe including a sole portion and envelope which are stretchable and flexible whereby any expansion or swelling of the athlete's foot attendant to any prolonged athletic exertion may be accommodated by the bicycle shoe without causing discomfort to the athlete.

Another object of the present invention is to provide a bicycle shoe which is comfortable, lightweight, aerodynamic and which is operable to obtain the individual benefits to be derived from related prior art bicycle shoes while avoiding the detriments individually associated therewith.

Another object of the present invention is to provide such a bicycle shoe which is characterized by ease of utilization, simplicity of construction and which further can be sold at a relatively moderate price.

These and other objects and advantages are achieved in a bicycle shoe of the subject invention wherein, in the preferred embodiment, the shoe includes a unitary sole portion having a bottom panel, and forwardly and rearwardly disposed sidewalls, and wherein the respective side walls partially enclose the athlete's foot; a harness made integral with the sole portion and having a base portion which is made integral with the bottom panel, and a plurality of releasably adjustable straps which are made integral with the forwardly and rearwardly disposed sidewalls, and wherein the harness is operable to secure the shoe on the athlete's foot; an envelope made integral with the sole portion and adapted to enclose the athlete's foot; a rigid insole operable for releasable mating receipt in the envelope and disposed in rested relation on the bottom panel; and a cushioned insole received in the envelope and disposed in rested receipt on the rigid insole and wherein the cushioned insole supports the athlete's foot.

DESCRIPTION OF THE PREFERRED EMBODIMENT

Figure 1:
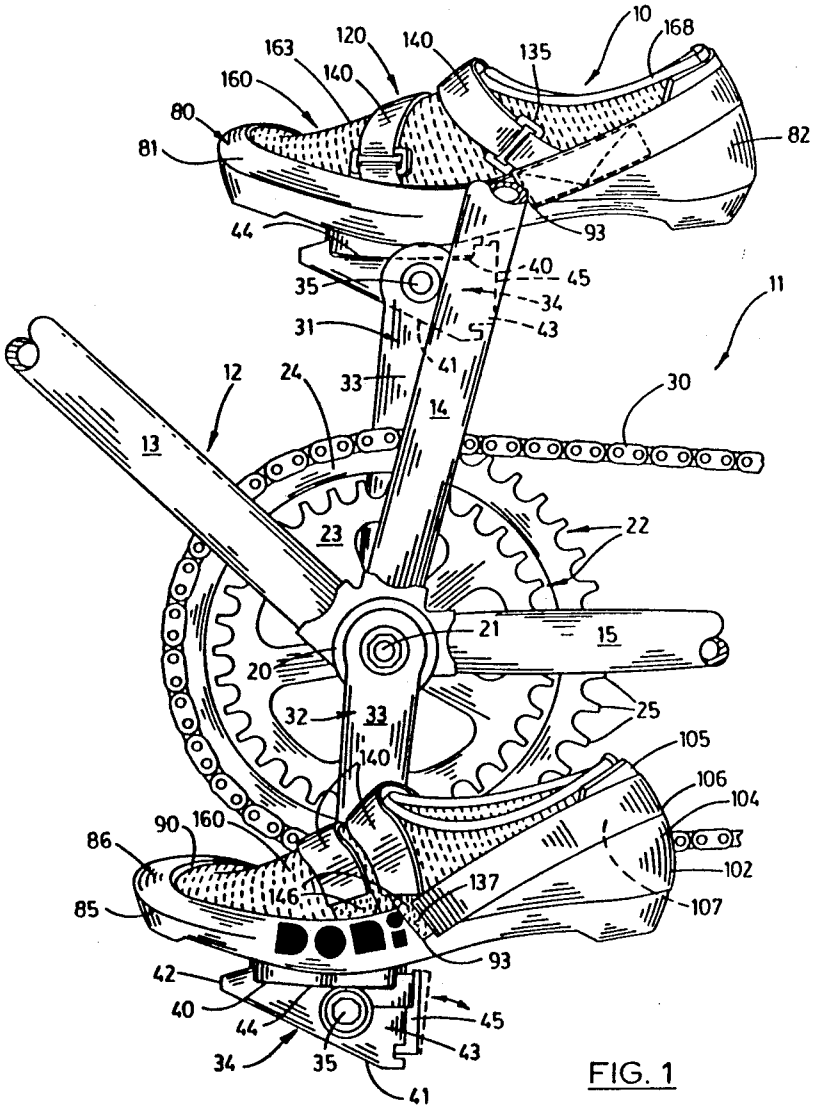
FIG. 1 is a perspective, side elevation view of the bicycle shoe of the present invention shown in a typical operative environment and wherein a pair of bicycle shoes are releasably affixed to the bicycle pedals of a racing bicycle.

Referring more particularly to the drawings the bicycle shoe of the subject invention is generally indicated by the numeral 10 in FIG. 1. For illustrative convenience the shoe 10 is shown and described herein as it would be utilized in connection with a bicycle 11. However it should be readily recognized that the subject invention could be employed in combination with any apparatus which mounts a pair of pedals. The pedals of the bicycle will be discussed in greater detail hereinafter.

The bicycle 11 is of conventional design and is therefore shown only fragmentarily in FIG. 1 hereof. The bicycle includes a rigid but lightweight frame 12 which includes first, second and third support members 13, 14, and 15 which converge together at an apex, and which are affixed to a tubular housing 20 of conventional design. The tubular housing is operable rotatably to support a threaded shaft 21 for rotation about a predetermined substantially horizontally disposed axis, and a plurality of sprockets 22, which will hereinafter be designated as first and second sprockets 23 and 24, respectively, are releasably fixed thereto and are operable for rotation therewith. The individual sprockets 23 and 24 are of conventional design and provide predetermined gear ratios for the bicycle 11. The sprockets have a plurality of teeth 25 which are able to mate with, or engage, a substantially continuous chain 30 thereby individually connecting the first and second sprockets in power transmitting or driving relation relative to the rear wheel of the bicycle, not shown. The first and second pedals 31 and 32, respectively, are rotatably mounted on individual cranks 33 which are respectively fixed on the opposite, distal ends, of the threaded shaft 21 in a manner which is well-understood in the art. Further, the first and second pedals include a base member 34 which is rotatably mounted for movement about a threaded shaft 35 which is threadably secured to each of the cranks at their respective distal ends. This is clearly illustrated by reference to FIG. 1. The base member 34 of the individual pedals has a top surface 40 and a bottom surface 41. Further, the individual pedals have first and second ends 42 and 43, respectively. As best illustrated by reference to FIG. 1 the top surface 40 defines a receiving station 44 which is operable to releasably mate with a cleat which is threadably fixed on the bottom surface of the bicycle shoe 10. The cleat, as well as the details of the construction of the bottom surface of the shoe will be discussed in greater detail hereinafter. The base member 34 further includes a spring-biased gate 45 which is movably mounted on the second end 43 and is operable to releasably mate with or engage the cleat thereby securing it in the receiving station as shown in FIG. 1.

Figure 6:
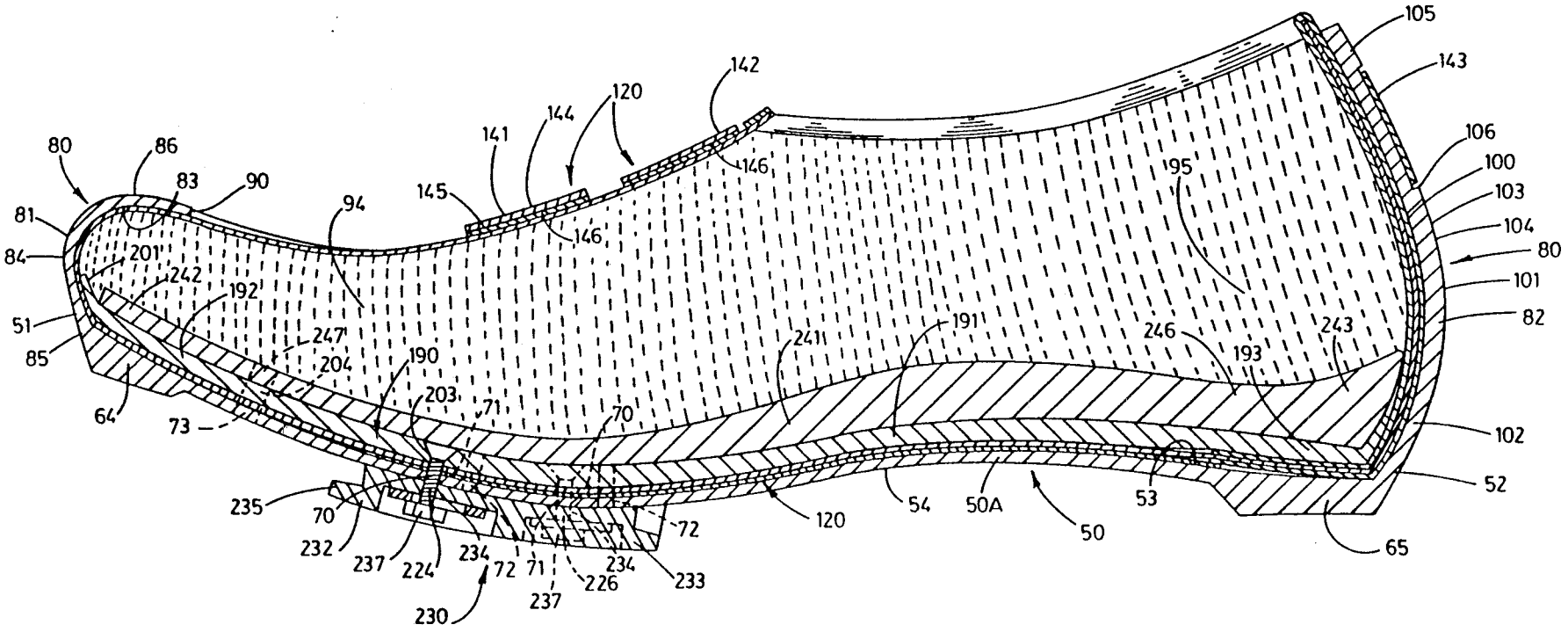
FIG. 6 is a longitudinal, vertical, sectional view of the bicycle shoe taken from a position along line 6—6 of FIG. 3.

As best illustrated by reference to FIG. 2 the bicycle shoe of the present invention 10 includes a stretchable and unitary sole portion and which is generally indicated by the numeral 50. The sole portion has a toe, or first end 51 and a heel or second end 52. Further the sole portion includes a bottom panel 50A which has an interior facing surface 53 and an exterior facing surface 54, respectively. The bottom panel is defined by a peripheral edge 55 which has left and right sides 60 and 61, respectively. As best illustrated by reference to FIG. 6, the bicycle shoe 10 includes longitudinal and transverse lines of reference 62 and 63, respectfully, and the sole portion further includes a thickened toe portion 64 and a thickened heel portion 65 as best seen by reference to FIG. 6. As best illustrated by reference to FIG. 2, a plurality of apertures 70 are formed in predetermined locations in the sole portion 50 and more particularly the bottom panel thereof and are operable to receive a plurality of threaded posts which will hereinafter be discussed in greater detail. The plurality of apertures include a first set of apertures 71 and a second set of apertures 72 which are disposed in predetermined spaced relationship one to the other. Further a ventilation aperture 73 is formed in the bottom panel and is disposed in spaced relation relative to the plurality of aperture 70 thereby permitting air to freely move in and out of the shoe in a fashion which ventilates the athlete's foot in an advantageous fashion. The sole portion of the bicycle shoe 10 is manufactured from polyurethane foam which is poured into open molds but could further be formed by injection molding techniques as appropriate. The sole portion is flexible and stretchable so as to accommodate the swelling of the athlete's foot which is usually attendant with long distance bicycle racing. This makes the shoe comfortable for the athlete to wear.

As best illustrated by reference to FIG. 2 the sole portion 50 includes forwardly and rearwardly disposed sidewalls 81 and 82, respectively, which partially enclose and support the athlete's foot. The first or forwardly disposed sidewall has an interior substantially curved surface 83 and an exterior surface 84. The interior surface closely complements the anatomical shape of the athlete's foot. As best illustrated by a study of FIGS. 1 and 2 the exterior surface 84 has a lower exterior surface 85 and an upper exterior surface 86. The lower exterior surface which is disposed along the peripheral edge 55 of the bottom panel 50A extends upwardly and outwardly relative to the peripheral edge until it joins with or meets the upper exterior surface at a distinctive apex which forms a continuous line, and wherein the upper exterior surface subsequently angles inwardly and upwardly therefrom. The upper exterior surface further includes a top peripheral edge 90. The first or forwardly disposed sidewall 81 includes a first end 91 and an opposite second end 92 which is positioned substantially midway or intermediate the bottom panel or otherwise at the instep of the athlete's foot. The forwardly and rearwardly disposed sidewalls define first and second areas 94 and 95 which partially encloses the athlete's foot. This is best imagined by a study of FIG. 2. The second or rearwardly disposed sidewall 82 includes an interior curved surface 100 and an exterior surface 101. Further the exterior surface has a lower exterior portion 102 and an upper exterior portion 103. The lower exterior portion angles upwardly and outwardly from the bottom panel 50A until joins or meets with the exterior portion at an apex, and wherein the exterior portion changes direction and angles inwardly and upwardly therefrom. The rearwardly disposed sidewall also has a first section 104 and a second section 105 which are made integral one with the other. The first section 104 has a predetermined height dimension which diminishes as the first section extends from the heel or second end of the bottom panel 50A toward the forwardly disposed sidewall. As should be evident by a study of FIG. 2, the forwardly and rearwardly disposed sidewalls are integral with the bottom panel thereby forming a unitary sole portion which is flexible, stretchable and resilient and which otherwise resists wear. As best seen by reference to FIGS. 2 and 6, a channel 107 is formed in the exterior surface 101 of the second section 105 and is operable to receive a releasably adjustable strap which is made integral with a harness of the present invention. The harness and its related strap will be discussed in greater detail in the paragraphs which follow.

A harness and which is generally indicated by the numeral 120 is secured on the interior facing surface 53 of the bottom panel 50A by the us of a suitable adhesive. The harness is manufactured from a nylon reinforced fabric such as Herculite ®. The subject fabric is manufactured by the Herculite Company of Emigsville, Pa. The harness 120 has a base portion 121 which has first and second ends 122 and 123, respectively, and a top and bottom surface 124 and 125, respectively. The bottom surface 125 is adhesively affixed on the inside facing surface of the bottom panel 50A. The base portion 121 is defined by a peripheral edge 126 which has inwardly and outwardly disposed portions 127 and 128, respectively. As best illustrated by reference to FIGS. 2 and 6 a plurality of apertures 130 are formed in the first end 122 of the base portion 121 and which are aligned in substantially coaxial registry with several of the apertures 70 and 71 respectively which are formed in the bottom panel 50A. The harness 120 further includes first, second, third and fourth portions 131, 132, 133, and 134, respectively, and which are individually affixed on the forwardly and rearwardly disposed sidewalls as will be hereinafter discussed, and which extend upwardly relative to the peripheral edge 126 of the base portion 121. More particularly, the first and second portions are affixed on the forwardly disposed sidewall and are made integral with the base portion 120. The first portion is positioned near the first end of the base portion and extends upwardly relative to the inside peripheral edge, and the second portion is positioned intermediate the first and second ends of the base portion and extends upwardly relative to the outside peripheral edge. Further, and as best illustrated by reference to FIG. 2 the third and fourth portions are individually affixed on the first section 104 of the rearwardly disposed sidewall 82 and individually extend upwardly relative to the inwardly and outwardly disposed peripheral edges 126 of the base portion 121 respectively. The individual portions are secured on the interior surface of the respective forwardly and rearwardly disposed sidewalls by the use of a suitable adhesive. As best seen by reference to FIGS. 2 and 3 the second and third portions have affixed at their respective distal ends individual rigid loops 135. Further the third portion has an exterior surface 136 which has affixed thereto one portion of a discrete length of Velcro ® tape 137. The significance of this element will be discussed hereinafter. As should be understood Velcro ® tape is a type of hook and loop fabric.

The harness 120 includes a plurality of flexible, substantially non-stretchable and releasably adjustable straps 140 and which will hereinafter be designated as first, second and third releasably adjustable straps 141, 142, and 143, respectively. The individual straps have interior and exterior facing surfaces 144 and 145, respectively. As best seen by reference to FIG. 2 discrete lengths of complementary mating portions of Velcro ® tape are individually affixed in predetermined positions along the exterior facing surface 145 of the first and second releasably adjustable straps such that when the individual straps are received through the respective loops 135 the straps may then be folded upon itself thereby placing the complementary portions of Velcro® tape into mating relation one with the other. By variously positioning the individual complementary portions one with the other the athlete may adjust each of the straps in a fashion whereby his foot is comfortably secured within the shoe. Further, the third releasably adjustable strap has a distal end 147 which has affixed thereto a complementary piece of Velcro® tape 148 which is operable to mate with the portion of Velcro® tape which is affixed to the third portion 133 of the harness 120 as earlier discussed. The third releasably adjustable strap is operable to be received in the channel 107 which is formed in the second section 105 of the rearwardly disposed sidewall 82. As should be understood, the third releasably adjustable strap provides additional support for the heel of the athlete's foot.

A breathable and stretchable envelope or sock 160 which is manufactured from a fabric such as a Lycra TM mesh is made integral with the bottom panel 50A and is disposed in covering relation relative to the base portion 121 of the harness 120. The envelope 160 is secured on the bottom panel, and on the inside surfaces 83 and 100 of the forwardly and rearwardly disposed sidewalls 81 and 82 by the use of a suitable adhesive. The envelope, which is operable to enclose the athlete's foot, has a first end 161 and a heel or second end 162, respectively. Further the envelope has a top surface 163 which is disposed or other positioned between the top peripheral edge 90 of the forwardly disposed sidewall in the manner as best illustrated by reference to FIG. 3; and a bottom surface 164, which is adhesively affixed on the bottom panel 50A of the sole portion 50. As best illustrated by reference to FIG. 2 a plurality of apertures are formed in the bottom surface 164 of the envelope 160, and are disposed in substantially coaxial registry with the aforementioned apertures 70 and 71 and which are formed in the sole portion 50 thereby providing a substantially continuous passageway for the individual threaded shafts which will be discussed in greater detail hereinafter. Further a ventilating aperture 167 is formed in the bottom surface and is disposed in substantial registry with the aforementioned aperture 73 which is formed in the bottom panel 50A. The envelope also includes a reinforcing elastic band 167 which is secured by adhesive or stitching to the envelope and which extends from the heel or second end 162 of the envelope substantially longitudinally forwardly relative to the bottom surface 164 of the envelope, and elastic piping 168 is secured by suitable stitching or other fastening techniques about the aperture 169 which permits access to the envelope. The fabric has a plurality of air passageways 170 formed therein which permits heat to escape from the envelope.

Figure 7:
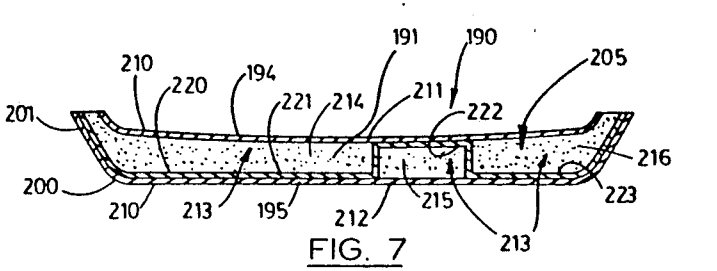
FIG. 7 is a transverse, vertical, sectional view of the rigid insole of the bicycle shoe of the present invention and taken from a position along line 7—7 of FIG. 2.
Figure 8:
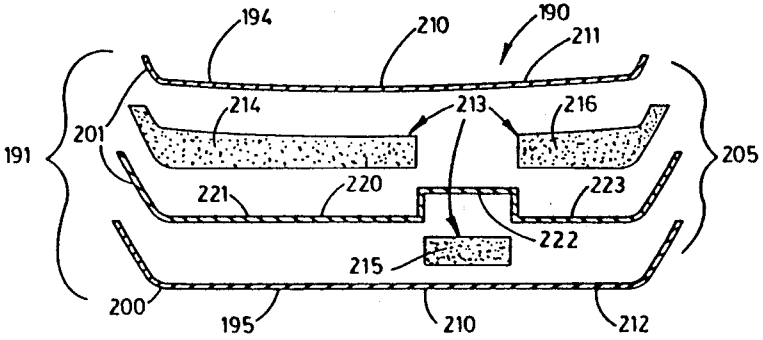
FIG. 8 is a transverse, vertical, exploded view of the rigid insole of the bicycle shoe of the present invention and taken from a position along line 7—7 of FIG. 2.

A rigid insole, and which is generally indicated by the numeral 190, has a main body 191 which has a general shape complementary to the anatomical shape of the bottom of the athlete's foot. As should be understood the rigid insole has some slight or minor flexibility, that is, it is capable of bending somewhat along its longitudinal axis. However, it generally provides the same competitive advantages as the inflexible wooden sole bicycling shoes described earlier. The main body 191 includes a first end 192 which is adapted to support the toes and forward portion of the athlete's foot, not shown, and an opposite second end 193 which is adapted to support the athlete's heel. Further, the main body 191 has an exterior facing surface 194 and an opposite interior facing surface 195. The rigid insole is adapted to be received in the envelope 160 and disposed in rested relation on the bottom surface 164 thereof. The rigid insole is removable. The significance of this feature will be discussed in greater detail hereinafter. The main body 191 further has a peripheral edge 200; and an angulated sidewall of limited height 201, is disposed along the peripheral edge and provides a means for substantially cradling or positioning the athlete's foot on the rigid insole 190 notwithstanding that the athletes foot spreads thereby getting wider when the athlete exerts pressure on the foot. As best seen by reference to FIG. 2 a plurality of apertures 203 are formed in a predetermined pattern in the main body 191 of the rigid insole and are disposed in substantially coaxial registry with the apertures 70 and 71 which are formed in the bottom panel 50A of the sole portion 50. Similarly a ventilation aperture 204 is formed in the main body of the rigid insole and is disposed in substantially coaxial registry with the air aperture 73 which is formed in the bottom panel 50A. As earlier discussed, the rigid insole is substantially inflexible but lightweight. These characteristics of the insole portion are imparted to it by the construction of the core portion 205 thereof. The core portion 205 is best illustrated by reference to FIGS. 7 and 8 and includes a pair of fiberglass layers 210 which are designated as an interior facing layer 211 and an opposite exterior facing layer 212. Sandwiched and bonded between the fiberglass layers 211 and 212 are a plurality of spaced, polyurethane foam cores which will hereinafter be designated as first, second and third foam cores 214, 215 and 216, respectively. The individual foam cores are made integral with a 100% carbon fiber core which is formed into a semi-corrugated or an omega-shaped internal structure as best shown by reference to FIG. 8. As illustrated therein the omega-shaped internal structure 220 defines first, second and third pockets 221, 222, and 223 and respectively which are operable to receive the individual foam cores 214, 215, and 216 respectively. When bonded appropriately together as shown in FIG. 7, the rigid insole becomes substantially inflexible as earlier discussed and further is rendered operable to support the first, second and third threaded posts 224, 225, and 226 which are received and secured in appropriate positions internally of the apertures 203 which are formed in the main body. This is shown most clearly by reference to FIG. 2. In addition to the foregoing, it should be understood that the threaded posts are selectively received in the first or second set of apertures 71 or 72 as appropriate. The relative positioning of the threaded posts in the first or second set of apertures permits the mounting fixture 230 to be adjustably positioned relative to the bottom panel 50A to suit any preferences of the athlete.

Figure 5:
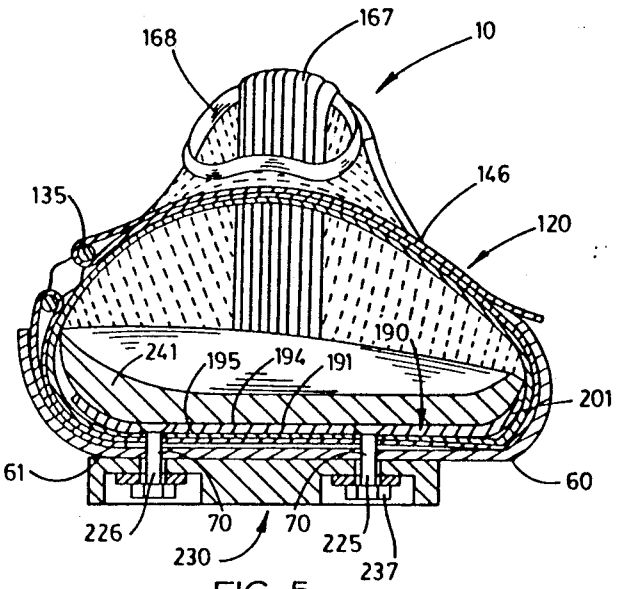
FIG. 5 is a substantially, transverse, vertical sectional view taken from a position along line 5—5 of FIG. 3.
Figure 4:
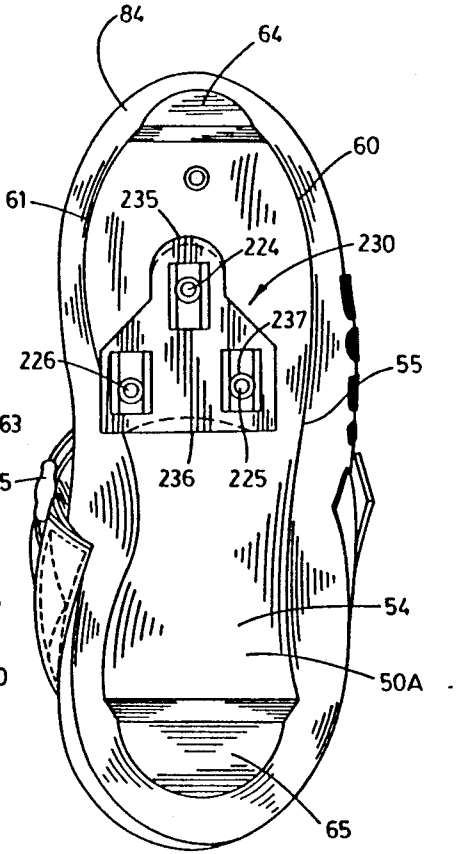
FIG. 4 is a bottom plan view of the bicycle shoe shown in FIG. 1.

A mounting fixture or cleat, and which is generally indicated by the numeral 230, includes a main body 231 which has forward and rearward ends and which has formed therein a plurality of apertures 234 which are disposed in a predetermined pattern wherein the individual apertures are positioned in substantially coaxial registry with the apertures 70 and 71 that are formed in the bottom panel 50A of the sole portion 50 as earlier discussed. As best illustrated by reference to FIG. 5 the individual threaded posts 224 through 226, respectively, are individually received in the coaxial aligned apertures which are formed in the rigid insole and extend normally outwardly relative to the exterior facing surface 54 of the bottom panel 50A as best shown by reference to FIG. 5. The mounting fixture includes forwardly and rearwardly disposed flange member 235 and 236 which are operable to permit the mounting fixture to be releasably mated with the base member 34 of the first and second pedals 31 and 32, respectively. As best illustrated by reference to FIG. 1, the rearwardly disposed flange member 236 is engaged by the spring biased gate 45 which is hingedly mounted relative to the base portion of the pedal as earlier discussed. As best illustrated by a study of FIG. 4, the mounting fixture 230 is releasably secured on the bottom panel 50A by a plurality of nuts 231 which screwthreadably engage the individual first, second and third threaded posts in the manner which is well understood by those skilled in the art.

A cushioned insole 240 is dimensioned for removable receipt internally of the envelope 160 and is operable to support the athlete's foot therein. The cushioned insole is manufactured in accordance with the teachings set forth in U.S. Pat. No. 4,823,483 to Chapnick, and therefore, for the sake of brevity the construction of same is not discussed in any detail herein. The cushioned insole has a main body 241 which includes a forward end 242 and a rearward end 243. The main body further includes a top surface 244 which has a roughened surface texture and which is formed from a wicking fabric of conventional design. Further, the cushioned insole has a cushioned instep portion 245 which provides comfort for the instep of the athlete's foot, not shown, and a padded and cup-shaped heel portion 246. In addition to the foregoing, a ventilation aperture 247 is formed in the main body and is disposed in substantially coaxial registry with the ventilation aperture 73 which is formed in the bottom panel. This, of course, provides the means by which air flowing through the various constituent elements of the shoe 10 may reach the envelope and thereby ventilate the athlete's foot to provide comfort during long distance races by dissipating the body heat attendant with such races.

OPERATION

The operation of the described embodiment of the present invention is believed to be readily apparent and is briefly summarized at this point.

Figure 2:
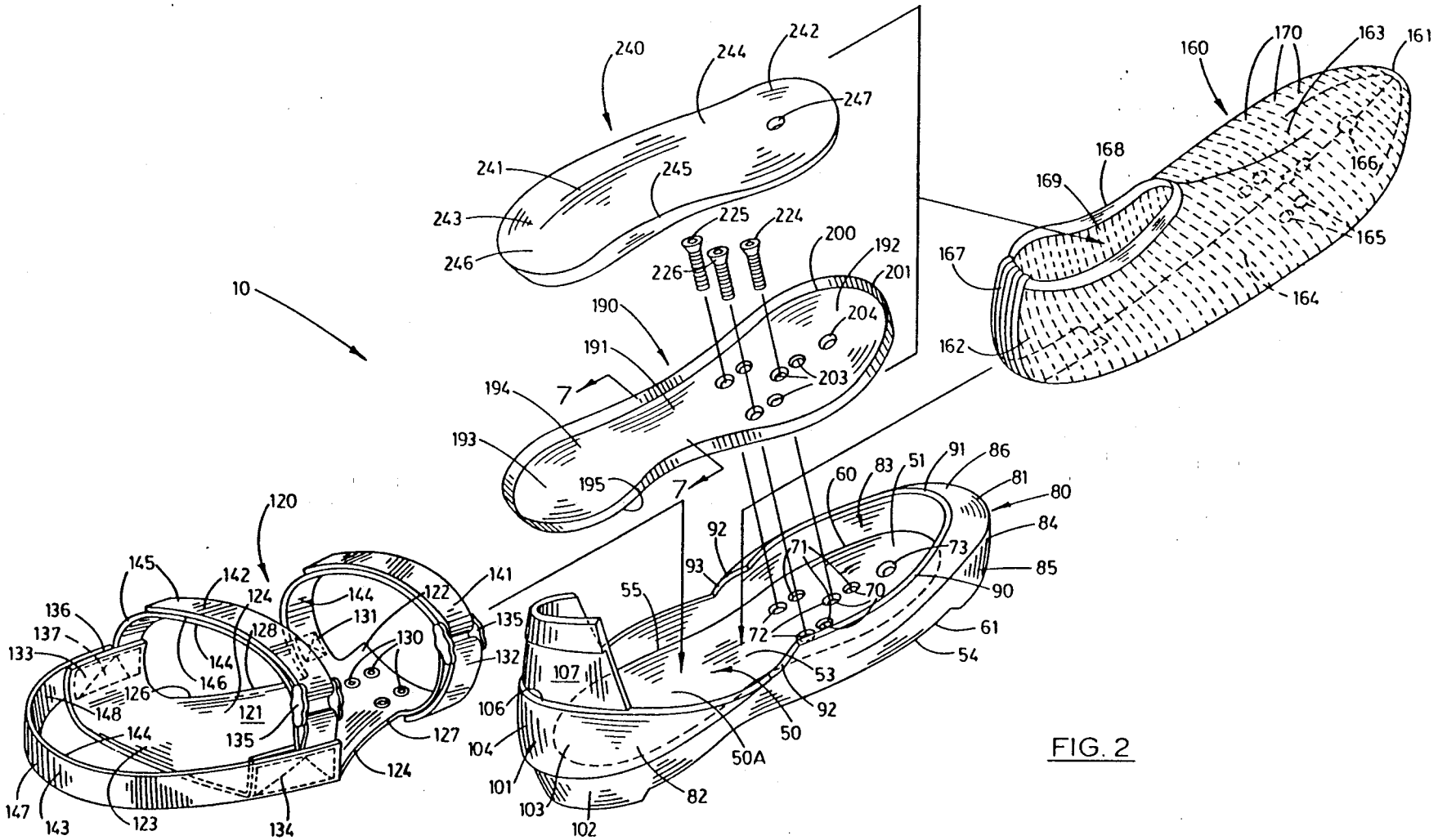
FIG. 2 is a somewhat enlarged, perspective, exploded view of one of the bicycle shoes shown in FIG. 1 and showing the structure thereof in greater detail.
Figure 3:
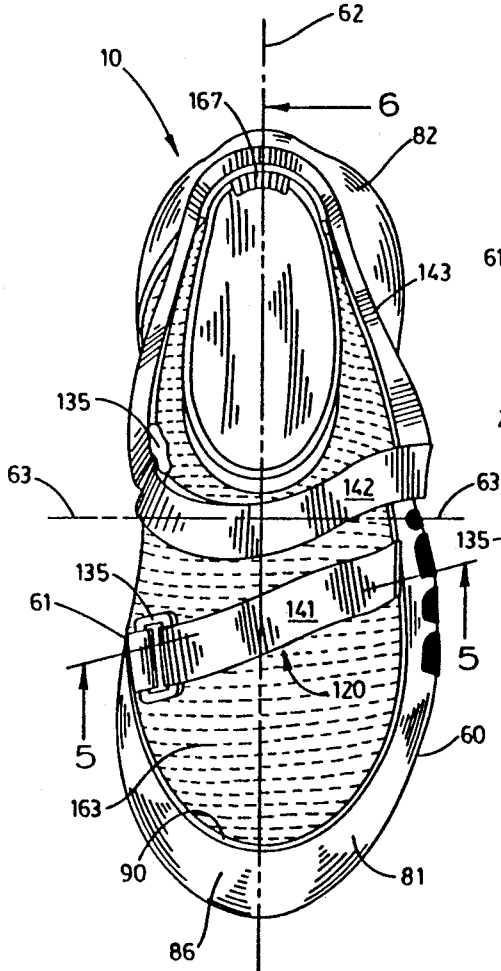
FIG. 3 is a top plan view of the bicycle shoe shown in FIG. 1.

The bicycle shoe 10 of the present invention is best understood by a study of FIGS. 1 and 2. As shown therein, the bicycle shoe 10 releasably is affixed on a pair of bicycle pedals 31 and 32 and which have a spring biased gate 45 which is operable to releasably engage a mounting fixture or cleat 230 which is screwthreadedly secured by utilizing suitable threaded posts 224, 225 and 226 on the bottom panel 50A of the bicycle shoe. As shown most clearly by reference to FIG. 2, the bicycle shoe 10 includes a unitary, stretchable sole portion 50 which includes forwardly and rearwardly disposed sidewalls 81 and 82 and which are operable to partially enclose the athlete's foot. Further, a stretchable and breathable envelope made form a fabric such as Lycra TM is made integral with the sole portion by an adhesive or the like and which is operable to enclose the athlete's foot. The envelope is positioned in covering relationship relative to the base portion 121 of a harness 120 which is suitably affixed on the sole portion 50 by an adhesive or the like. The harness includes a plurality of releasably adjustable straps 141, 142 and 143 which are disposed in covering relation relative to the top surface 124 of the envelope 120 as earlier discussed. The individual straps are made releasably adjustable by means of discreet lengths of complementary portions of Velcro® tape which are individually affixed thereto. A rigid insole 190 having an omega-shaped internal structure formed of carbon fiber 220 is adapted to be received internally of the envelope 160 and is operable to receive and support the individual threaded posts 224, 225, and 226 respectively. Further, a cushioned insole 240 is received internally of the envelope and is disposed in rested receipt on the rigid insole and provides a means for supporting the athlete's foot internally of the envelope. The material selected for the sole portion 50 and envelope 160 are stretchable thereby readily accommodating swelling or expansion of the athlete's foot which may be attendant with the muscular exertion provided during long distance bicycle races. As discussed earlier, the rigid insole provides all the advantages characterized heretofore by wooden sole shoes but which are further lightweight and provides some minimal flexibility not possible with a wooden sole shoe. In addition to the foregoing the bicycle shoe 10 of the present invention is comfortable to wear inasmuch as the bicycle shoe includes a ventilation aperture in the bottom panel 50A which permits air to move into and out of the envelope 160 thereby ventilating the athlete's foot.

Therefore it will be seen that the bicycle shoe 10 of the present invention has particular utility when utilized in combination with a racing bicycle 11 of conventional design and further provides a fully dependable and practical means for releasably connecting the athlete's foot to a pedal assembly as earlier discussed. The bicycle shoe of the subject invention further is operable to be comfortably adjusted by utilizing a plurality of releasably adjustable straps to suit any operational conditions or preferences of the athlete, and is both of sturdy and dependable construction and relatively inexpensive to maintain.

Although the invention has been herein shown and described in what is conceived to be the most practical and preferred embodiment, it is recognized that departures may be made therefrom within the scope of the invention which is not to be limited to the illustrative details disclosed.

Having described my invention what I claim is new and desire to secure by Letters Patents is:

1. A shoe for use by an athlete in the sport of bicycling comprising:

a sole portion including a bottom panel which has interior and exterior facing surfaces, and forwardly and rearwardly disposed sidewalls which partially enclose and support the athlete's foot, the individual sidewalls including an interior facing surface, and wherein the bottom panel further includes a plurality of apertures which are disposed in a predetermined pattern, and wherein the rearwardly disposed sidewall includes first and second sections, and wherein the first section is integral with the bottom panel and has a predetermined height dimension which diminishes as the first section extends from the rearmost area of the shoe towards the forwardly disposed sidewall, and wherein the second section is integral with the first section and extends upwardly relative thereto and has a channel formed therein;

a stretchable envelope made integral with the interior facing surfaces of the sole portion and forwardly and rearwardly disposed sidewalls, respectively;

a harness made integral with the interior facing surface of the sole portion and which is disposed in a position in covering relation relative to the envelope, the harness operable to secure the shoe on the athlete's foot;

a rigid insole received in the envelope and which has main body having a peripheral edge and a sidewall which is disposed along the peripheral edge, and wherein the main body further includes a plurality of apertures which are disposed in a predetermined pattern and in substantially coaxial alignment relative to the apertures formed in the bottom panel;

a plurality of threaded shafts, which are individually and slideably received in each of the coaxially aligned apertures;

a mounting fixture secured on the exterior facing surface of the bottom panel by the plurality of threaded shafts, the mounting fixture securing the shoe on the bicycle pedal; and a cushioned insole received in the envelope and positioned in covering relation to the rigid insole, the cushioned insole supporting the athlete's foot.

2. A shoe as claimed n claim 1 and wherein the harness includes a base portion which is fixed on the bottom panel of the sole portion and which has a length dimension which is less than the length dimension of the sole portion, and wherein the harness further includes first, second and third releasably adjustable straps, and wherein the first releasably adjustable strap is fixed on the forwardly disposed sidewall and disposed in a position substantially transversely of the shoe and intermediate the instep and the toes of the athlete's foot, and wherein the second releasably adjustable strap is fixed on the rearwardly disposed sidewall and disposed in a position substantially transversely of the shoe and in covering relation relative to the instep of the athlete's foot, and wherein the third releasably adjustable strap is fixed on the rearwardly disposed sidewall and is received in the channel formed in the second section of the rearwardly disposed sidewall, the third releasably adjustable strap providing support for the athlete's heel.

3. A shoe as claimed in claim 2 and wherein the bottom panel, rigid insole, and cushioned insole each have an aperture which is substantially coaxial aligned and which permits air to move in and out of the envelope thereby ventilating the foot of the athlete, and wherein the plurality of apertures include first and second sets of apertures which are individually disposed in predetermined spaced relation one to the other, and wherein the first and second sets of apertures permit the mounting fixture to be adjustably positioned relative to the bottom surface.

4. A shoe as claimed in claim 3 and wherein the sole portion is manufactured from polyurethane foam, and the envelope is manufactured from a stretchable fabric, and wherein the rigid insole is light weight and has an internal structure manufactured from carbon fiber.

5. A shoe as claimed in claim 4 and wherein the rigid insole further includes three polyurethane foam cores which are disposed in a predetermined pattern, and wherein the carbon fiber is disposed between the three foam cores to form the internal structure, and wherein the rigid insole further includes a pair of fiberglass layers, and wherein the internal structure is sandwiched and bonded between the fiberglass layers.

6. A shoe for use in the sport bicycling comprising:

a stretchable and flexible sole portion having a bottom panel and forwardly and rearwardly disposed sidewalls which partially enclose the athlete's foot, and wherein a plurality of apertures are formed in the bottom panel, and wherein the shoe has longitudinal and transverse lines of reference, and the sole portion permits expansion of the athlete's foot in the longitudinal and transverse directions, and wherein the forwardly disposed sidewall is operable to partially enclose the forward portion of the athlete's foot, and wherein the rearwardly disposed sidewall encloses the heel of the athlete, and includes a first portion which is made integral with the bottom panel and which has a diminishing height dimension, and wherein the rearwardly disposed sidewall further includes a second portion which is made integral with the first portion and which partially encloses the heel of the athlete, and wherein a channel is formed in the second portion;

a harness made integral with the sole portion and having a base portion, and first and second releasably adjustable straps, and wherein the base portion is made integral with the bottom panel, and the first strap is made integral with the base portion and extends substantially transversely relative to the shoe, and wherein the second adjustable strap which is made integral with the base portion is received in the channel, and is adapted to secure the heel of the athlete in the shoe;

an envelope for enclosing the athlete's foot secured on the bottom panel, and the forwardly and rearwardly disposed sidewalls, respectively, the envelope being breathable, and stretchable and flexible in the longitudinal and transverse directions;

a rigid insole operable for mating receipt in the envelope, the rigid insole including a plurality of apertures which are disposed in substantially coaxial registry with the apertures formed in the bottom panel;

a plurality of posts individually received in each of the coaxially aligned apertures and which extend substantially normally outwardly relative to the bottom panels; and a cushioned insole received in the envelope and disposed in rested receipt on the rigid insole, and wherein the cushioned insole supports the athlete's foot.

7. A shoe as claimed in claim 6 and wherein the first releasably adjustable strap is fixed on the forwardly disposed sidewall and the second releasably adjustable strap is fixed on the rearwardly disposed sidewall, and wherein the bottom panel, rigid insole, and cushioned insole have at least one aperture which is substantially coaxially aligned and which permits air to readily move in and out of the envelope thereby ventilating the athlete's foot.

8. A shoe as claimed in claim 7 and wherein the rigid insole and the cushioned insole are readily removable from the envelope, and wherein the plurality of apertures formed in the bottom surface includes six apertures which are disposed in first and second patterns of three apertures each, and wherein the plurality of posts are adapted to be screwthreadably secured to a mounting fixture which is fixed on the bottom panel and disposed in exterior facing relation thereto, and wherein the first and second patterns of apertures permits the mounting fixture to be adjustably positioned relative to the bottom panel.

9. A shoe for use by an athlete in bicycling comprising:

a unitary sole portion which is lightweight and stretchable and which has a bottom panel which has formed therein a plurality of apertures, and wherein the sole portion further includes a forwardly disposed sidewall which extends upwardly a predetermined distance from the bottom surface to form a first area which is adapted to partially enclose the forward portion of the athlete's foot, and a rearwardly disposed sidewall which extends upwardly from the bottom surface and which defines a second area which is adapted to enclose and provide support for the athletes heel, and wherein the sidewall of the rearwardly disposed portion includes first and second sections, and wherein the first section has a diminishing height dimension, and wherein the second section extends upwardly relative to the first section and partially encloses the athletes heel, and which further includes an exterior surface having a channel of predetermined dimensions formed therein;

a harness made integral with the sole portion and including a base member which is fixed on the bottom panel, and which has first and second ends, and inwardly and outwardly disposed peripheral edges, and wherein the harness further includes first, second, third, and fourth portions, and wherein the first and second portions are fixed on the forwardly disposed sidewall, and wherein the first portion is positioned near the first end and extends upwardly relative to the inside peripheral edge, and wherein the second portion is positioned intermediate the first and second ends and extends upwardly relative to the outside peripheral edge, and wherein the third and fourth portions are individually fixed on the first section of the rearwardly disposed sidewall and individually extend upwardly relative to the inwardly and outwardly disposed peripheral edges, respectively, and wherein the harness further includes first, second and third releasably adjustable straps, and wherein the first strap is operable to releasably connect the first and second portions together and thereby secure the athletes foot in the first area of the shoe, and wherein the second strap is adapted to connect the third and fourth portions together thereby securing the athletes heel in the second area, and wherein the third strap is adapted to connect the third and fourth portions together and is further received in the channel made integral with the second section of the rearwardly disposed sidewall, the third strap providing further support for the athletes heel;

an envelope which is stretchable and breathable and which is adapted to receive and enclose the users foot, the envelope made integral with the unitary sole portion;

a rigid insole having a predetermined shape and operable for receipt in the envelope, and wherein a plurality of apertures are formed in the insole and are adapted to be disposed in substantially coaxial registry with the apertures formed in the unitary sole portion;

a plurality of threaded posts individually received in the apertures formed in the unitary sole portion and the rigid insole respectively; and a cushioned insole operable to be received in the envelope and disposed in rested relation on the rigid insole, and in covering relation relative to the threaded posts.

10. A shoe as claimed in claim 9 and wherein the unitary sole portion has predetermined longitudinal and transverse dimensions and wherein the unitary sole portion is stretchable in both the longitudinal and transverse directions, and wherein the forwardly disposed sidewall has a substantially uniform height dimension throughout its respective length, and wherein the bottom panel has a ventilating aperture.

11. A shoe as claimed in claim 10 and wherein the envelope is stretchable in the longitudinal and transverse directions and wherein the envelope, rigid insole, and the cushioned insole have individual apertures which are substantially disposed in coaxial alignment with the ventilating aperture formed in the bottom panel thereby permitting ventilation of the envelope.

12. A shoe as claimed in claim 11 and wherein the first portion includes a rigid loop, and wherein the second portion includes a first releasably adjustable strap and wherein the first strap has an exterior facing surface and a predetermined longitudinal dimension, and wherein velcro tape having respective complementary portions are individually secured in predetermined positions along the exterior facing surface, and wherein the strap is received through the rigid loop and folded upon itself such that the complementary portions of velcro tape are disposed in releasable mating engagement one with the other.

13. A shoe as claimed in claim 12 and wherein the third portion includes a rigid loop, and the fourth portion includes the second releasably adjustable strap, and wherein the second strap has an exterior facing surface and a predetermined longitudinal dimension, and wherein velcro tape having complementary portions are individually secured in predetermined positions along the exterior facing surface, and wherein the second strap is received through the loop and folded upon itself such that the complementary portions of velcro tape are disposed in releasable mating engagement one with the other.

14. A shoe as claimed in claim 13 and wherein the third portion includes the third releasably adjustable strap and wherein the fourth portion has an exterior facing surface and the third releasably adjustable strap includes a distal end, and wherein velcro tape having complementary portions are individually secured on the exterior facing surface of the fourth portion and on the distal end of the third releasably adjustable strap, respectively, whereby the distal end of the third strap and the fourth portion are releasably mated together.

15. A shoe as claimed in claim 14 and wherein the apertures formed in the bottom surface includes three apertures which are disposed in a predetermined pattern, and wherein the threaded posts are secured to a mounting fixture.

16. A shoe for use by an athlete in the sport of bicycling comprising:

a sole portion having a bottom panel which includes forwardly and rearwardly disposed sidewalls, and wherein the forwardly disposed sidewall partially encloses the forward portion of the athlete's foot, and the rearwardly disposed sidewall enclosed the athlete's heel, and wherein the bottom panel, and the forwardly and rearwardly disposed sidewalls, respectively, have interior and exterior facing surfaces, and wherein the exterior surface of the rearwardly disposed sidewall has a channel formed therein, and wherein an aperture is formed in the bottom panel;

envelope for enclosing the athlete's foot and which is fixed on the interior facing surfaces of the bottom panel and the forwardly disposed sidewall, respectively;

a harness having a base portion and first and second adjustable straps, and wherein the base portion is fixed on the bottom panel, and the first and second straps are fixed on the base portion, and wherein the first strap extends substantially transversely relative to the major axis of the shoe and is disposed in covering relation relative to the envelope, and wherein the second strap is received in the channel and is operable to substantially secure the athlete's heel in the shoe;

a rigid insole operable for mating receipt in the envelope, the rigid insole having an aperture which is disposed in substantially coaxial alignment relative to the aperture formed in the bottom panel;

a fastener received in the coaxial aligned apertures; and a cushioned insole received in the envelope and disposed in rested receipt on the rigid insole and wherein the cushioned insole supports the athlete's foot.

* * * * *

UNITED STATES PATENT AND TRADEMARK OFFICE

CERTIFICATE OF CORRECTION

PATENT NO. : 5,086,576

DATED : February 11, 1992

INVENTOR(S) : Donald W. Lamson

It is certified that error appears in the above-identified patent and that said Letters Patent is hereby corrected as shown below:

Column 1, line 40, after the word "which" delete the letters --ar-- and insert --are--.

Column 2, line 31, after the words "maintaining the" insert an --'-- in the word --althelete s--.

Column 6, line 9, after the phrase "50A by the" delete the word --us-- and insert the word --use--.

Column 8, line 38, delete the words --and respectively-- and insert --respectively and--.

Column 15, line 3, at the beginning of the line and before the word "envelope" insert --an--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*